US005577822A

United States Patent [19]

Seon

[11] Patent Number: 5,577,822

[45] Date of Patent: Nov. 26, 1996

[54] REFRIGERATOR HAVING VARIABLE VOLUME FOOD STORAGE COMPARTMENT

[75] Inventor: Jin K. Seon, Suwon, Rep. of Korea

[73] Assignee: Samsung Electronics Co., Ltd., Suwon, Rep. of Korea

[21] Appl. No.: 352,813

[22] Filed: Dec. 1, 1994

[30] Foreign Application Priority Data

Dec. 8, 1993 [KR] Rep. of Korea ..... 1993-26911

[51] Int. Cl.[6] ..... A47B 96/04

[52] U.S. Cl. ..... 312/404; 312/401; 312/405; 312/406; 312/406.2; 312/407; 62/329

[58] Field of Search ..... 312/404, 401, 312/405, 406, 406.2, 407; 108/106, 107, 144; 211/187; 62/329, 449

[56] References Cited

U.S. PATENT DOCUMENTS

| | | | |
|---|---|---|---|
| 2,622,412 | 12/1952 | Staebler | 62/329 |
| 2,682,754 | 7/1954 | Eck | 312/404 X |
| 3,027,732 | 4/1962 | Mann et al. | 62/329 X |
| 3,590,594 | 7/1971 | Arend | 62/329 X |
| 4,638,644 | 1/1987 | Gidseg | 62/329 |
| 4,801,181 | 1/1989 | Cordill et al. | 312/407 |
| 4,876,860 | 10/1989 | Negishi | 62/329 X |
| 4,936,641 | 6/1990 | Bussan et al. | 211/187 X |
| 4,955,676 | 9/1990 | Weaver et al. | 312/407 |

FOREIGN PATENT DOCUMENTS

| | | | |
|---|---|---|---|
| 2072822 | 10/1981 | United Kingdom | 62/329 |

*Primary Examiner*—Peter M. Cuomo
*Assistant Examiner*—Rodney B. White
*Attorney, Agent, or Firm*—Burns, Doane, Swecker & Mathis, L.L.P.

[57] ABSTRACT

A refrigerator is divided into a freezing compartment and a cooling compartment. An intermediate partition wall separates the compartments. The partition wall is vertically adjustable for increasing a volume of one of the compartments while simultaneously reducing a volume of the other compartment. The door carries a vertically adjustable sealing member for engaging a front surface of the partition wall. The freezing compartment includes an evaporator separated from the remainder of the freezing compartment by a vertical isolating wall, a portion of which isolating wall is spring-biased toward the partition wall.

16 Claims, 7 Drawing Sheets

REFRIGERATOR HAVING VARIABLE VOLUME FOOD STORAGE COMPARTMENT

BACKGROUND OF THE INVENTION

This invention relates to a variable volume type refrigerator in which the volume of the freezing chamber and the cooling chamber are variable for efficient utilization of the foodstuff's interior storage space.

FIG. 1 illustrates the sectional configuration of a conventional refrigerator. The refrigerator has an outer cabinet 1 for providing the foodstuff's storage space and a door 2 which is mounted in the front of the cabinet 1 to open and close the foodstuff's storage space.

The foodstuff's storage space is divided into a freezing chamber 4 and a cooling chamber 5 by the use of an intermediate partition wall 3. An evaporator 7 and a fan 8 which are used for maintaining stored foodstuffs at a low temperature are arranged under the freezing chamber 4, while a compressor 9 is arranged at the lower part of the cabinet 1.

In such a refrigerator, the relative volumes of the freezing chamber 4 and the cooling chamber 5 are fixed at a predetermined rate due to the intermediate partition wall 3 that is fixedly attached to the interior of the cabinet 1. Therefore, since the freezing chamber 4 and the cooling chamber 5 must be used within a predetermined volume, irrespective of amount and sizes of foodstuffs to be stored, the conventional refrigerator causes a difficult problem in the case that many foodstuffs should be unexpectedly stored in the freezing chamber 4 or the cooling chamber 5, and in the case that a foodstuff of relatively large size should be stored therein.

The object of this invention is to provide a refrigerator which is able to vary the volumes of the freezing chamber and the cooling chamber for efficient use of the foodstuff's storage space.

SUMMARY OF THE INVENTION

In a variable volume type refrigerator including an outer cabinet for forming the foodstuff's storage space, a door for opening and closing the foodstuff's storage space, and an intermediate partition wall for dividing the foodstuff's storage space into a plurality of compartments such as a freezing chamber and a cooling chamber, support means is formed lengthwise in the inner wall of the cabinet, and engaging means is formed on the intermediate partition wall in such a manner for ease in mounting/demounting the support means, and as a result, the installation position of the intermediate partition wall can be shifted up or down on the inner wall of the cabinet.

Accordingly, the volumes of the freezing chamber and the cooling chamber can be changed relative to each other.

The support means is comprised of a set of first insert holes arrayed in rows of lengthwise direction on the sides of rear of the inner wall, and a second set of insert holes arrayed in rows of lengthwise direction on opposite side walls of the inner wall.

The engaging means is comprised of a first pair of projections formed on opposite sides of the rear intermediate partition wall so as to be inserted into any one row of the first insert holes, and a second pair of projections formed on opposite side surfaces of the intermediate partition wall so as to be inserted into any one row of the second insert holes.

In order to cover the space between the variable-position intermediate partition wall and the isolating wall which is fixedly mounted to the rear of the freezing chamber, a shutting means which can be moved in an upward or downward direction is provided between the intermediate partition wall and the isolating wall. The shutting means is comprised of a guide slot formed lengthwise in the isolating wall, a screen inserted into the guide slot, and an elastic member disposed between the guide slot and the screen so as to make the screen move elastically.

In order to seal up the clearance between the inner wall of the door and the front of the intermediate partition wall when the door is closed, sealing means is provided on the inner wall of the door, and can be shifted to a position in accordance with the position-shift of the intermediate partition wall. The sealing means is comprised of a door panel attached to the inner wall of the door, insert holes arrayed in rows on opposite sides of the door panel, a sealing member fitted in any one row of the insert holes in accordance with the position-shift of the intermediate partition wall, and a pair of engaging members fitted in openings of the sealing member and the insert holes to fix/separate the sealing member to/from the door panel.

Each engaging member is comprised of a first element which includes a hooked portion hung on an insert hole of the door panel, an operating portion extending in L-shape from the hooked portion to be hung on the opening of the sealing member, a second element which is of the same form as the first element and arranged symmetrically with the first element, and an elastic member disposed between the first and second elements to elastically connect them.

By such a structure, when the operating portions of the first and second elements are squeezed toward each other, causing the elastic member to become compressed, the hooked portions can be removed from the opening of the door panel. Conversely, when the force acting upon the operating portions is released, the elastic member returns to its normal state and the hooked portions are again hung on the opening of the door panel. The sealing member is engaged and removed from the openings of the door panel by the action of the engaging member.

Furthermore, gaskets are attached to the edge of the sealing member so that the clearance between the door and the intermediate partition wall is completely sealed when the door is closed.

DESCRIPTION OF THE PREFERRED EMBODIMENTS

Figure 1:
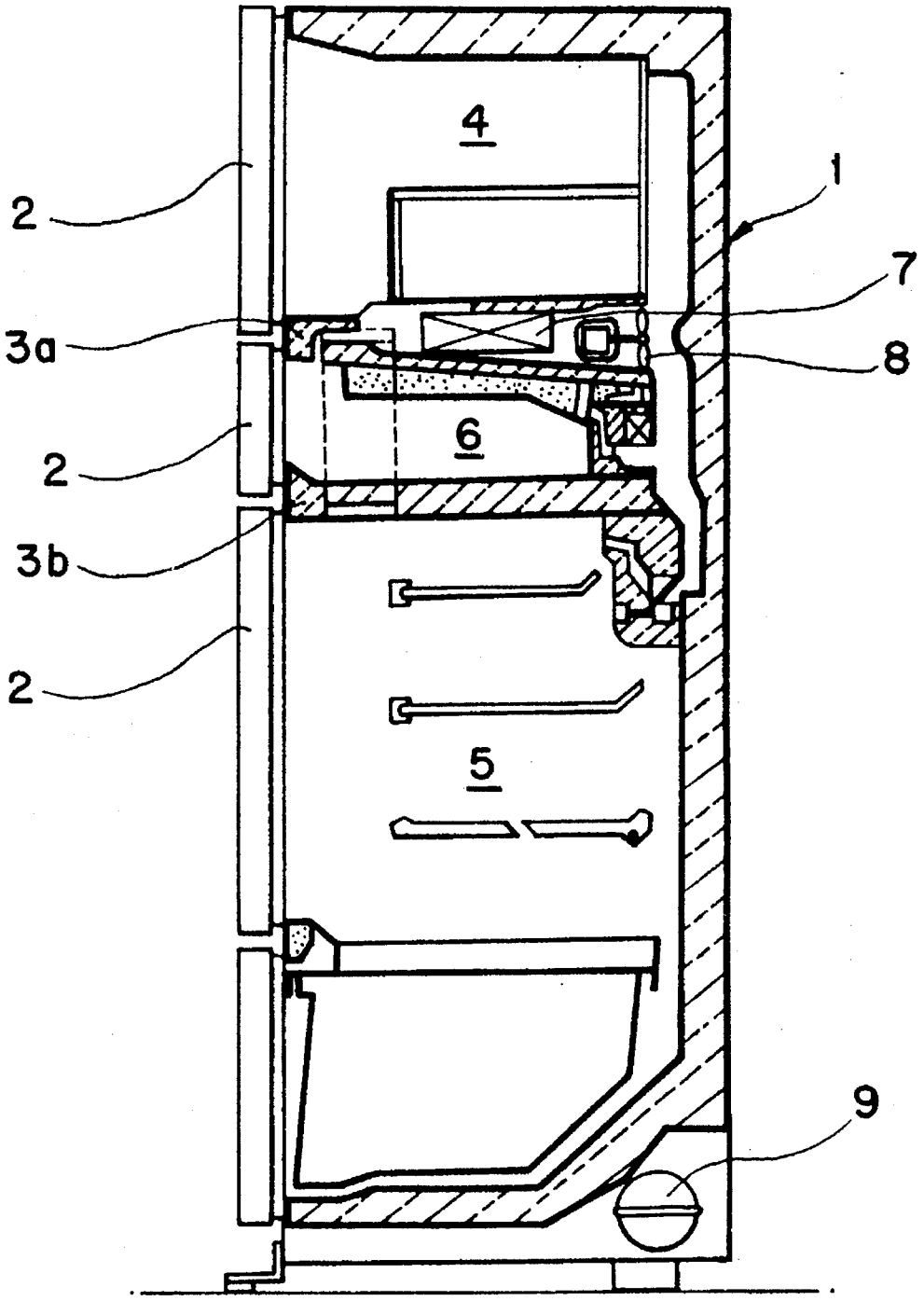
FIG. 1 (PRIOR ART)
FIG. 1 is a vertical sectional view of a conventional refrigerator.
Figure 2:
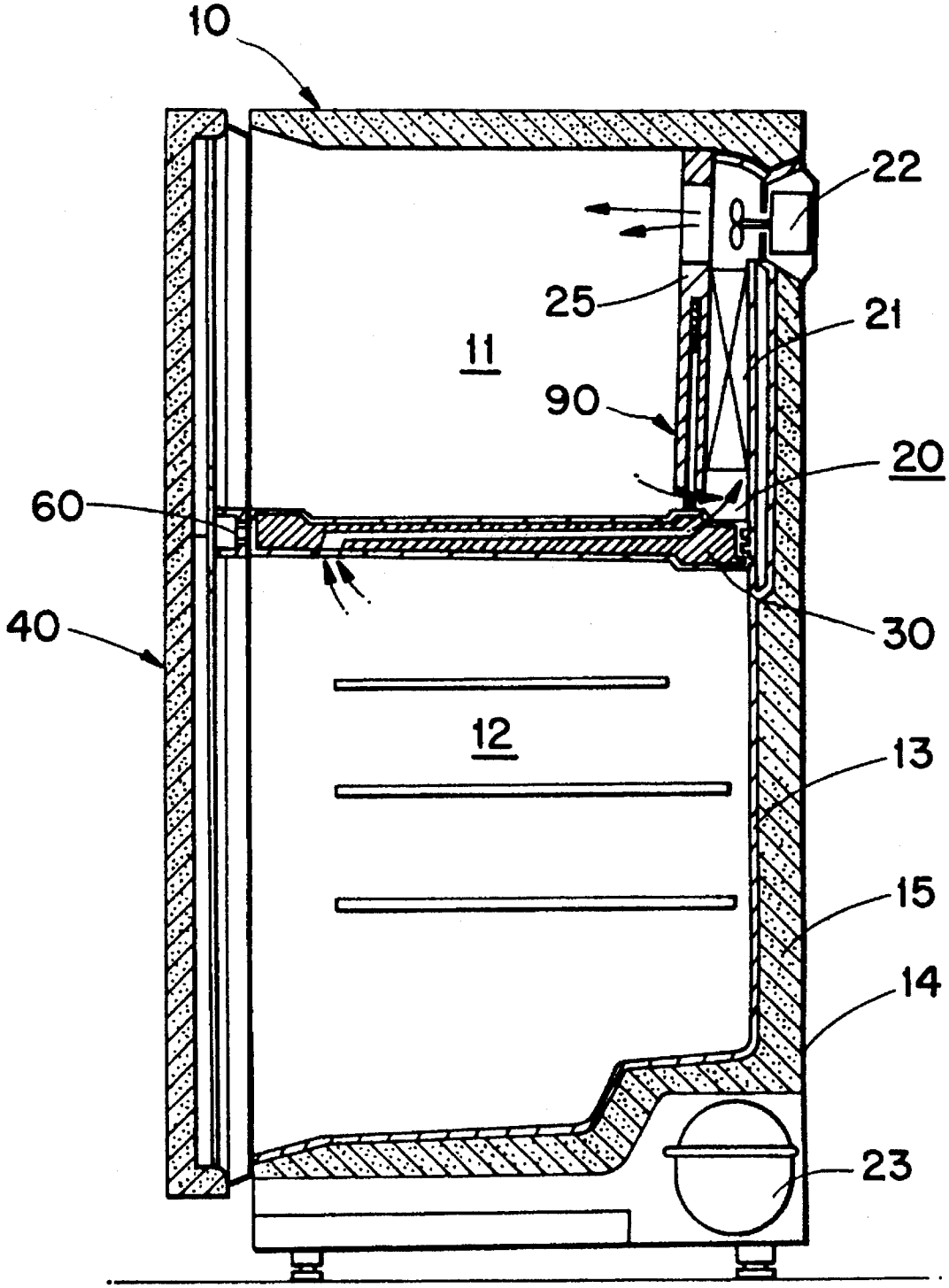
FIG. 2 is a vertical sectional view of a type refrigerator in accordance with this invention.

FIG. 2 is a sectional elevation of a variable volume type refrigerator in accordance with this invention. In the refrigerator, the inside of an outer cabinet 10 which forms the foodstuff's storage space is divided by an intermediate partition wall 30 into an upper part which is used as a freezing chamber 11, and a lower part which is used as a cooling chamber 12.

A refrigerator door 40 for opening and closing the foodstuff's storage space is mounted on the front of the cabinet 10.

A cooling apparatus compartment 20 in which an evaporator 21 and a fan 22 are arranged, is provided in the rear portion of the freezing chamber 11. The cooling apparatus compartment 20 is isolated from the freezing chamber 11 by an isolating wall 25.

The cabinet 10 is comprised of an inner wall 13 and an outer wall 14, and heat-insulation materials 15 are used to fill the gap between the inner wall 13 and the outer wall 14. A compressor 23 for compressing refrigerant to a high pressure and temperature is mounted on the lower portion of the cabinet 10.

This invention, which is adapted to the aforementioned refrigerator, comprises an intermediate partition wall 30 which is able to be shifted in position for upward or downward directions to relatively change the volumes of the freezing chamber 11 and the cooling chamber 12, shutting means 90 for shutting up the variable space between the intermediate partition wall 30 and the isolating wall 25, and sealing means 60 for sealing the clearance between the intermediate partition wall 30 and the inner wall 41 of the door 40.

Figure 3:
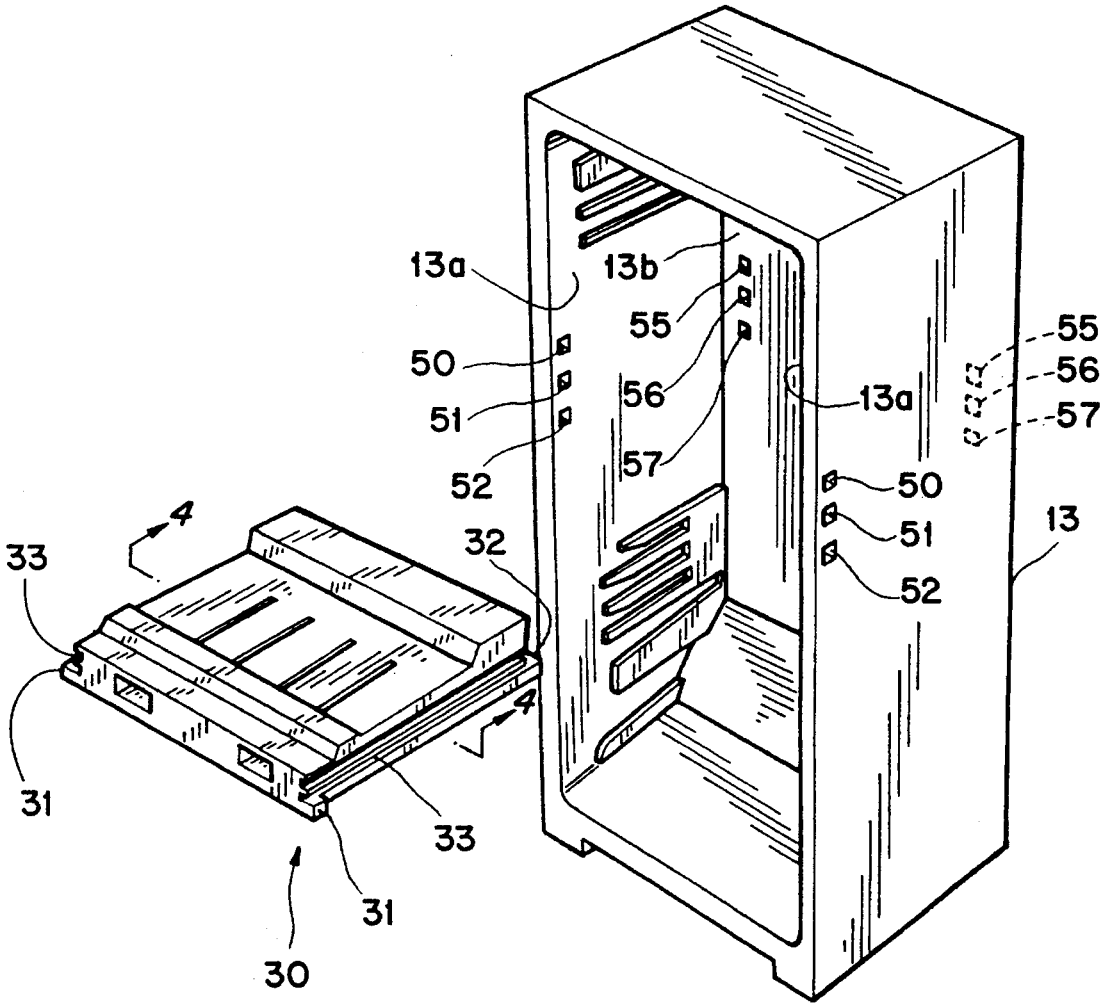
FIG. 3 is a perspective exploded view showing an intermediate partition wall and a refrigerator cabinet of this invention.

FIG. 3 is a perspective view for showing that the intermediate partition wall 30 is demountably fitted in the inner wall 13 of the cabinet 10.

A first pair of projections 31 extend toward opposite sides from the front end of the intermediate partition wall 30, respectively. Additionally, a second pair of projections 32 extend toward the rear inner wall **13*b* from the rear surface of the intermediate partition wall 30**.

A plurality of insert holes 50, 51, 52 for receiving the first projections 31 are formed on the front of the right and left sides **13*a* of the inner wall 13, and a plurality of insert holes 55, 56, 57 for receiving the second projections 32 are formed on opposite sides of the rear surface 13*b* of the inner wall 13**.

Insert hole 50 is on the same level as insert hole 55, insert hole 51 is on the same level as insert hole 56, and insert hole 52 is on the same level as insert hole 57; thereby, forming a plurality of rows in lengthwise direction.

Therefore, the installation position of the intermediate partition wall 30 is variable because the first and second set of projections 31 and 32, formed on the intermediate partition wall 30, can be selectively inserted into any one of the plurality of rows.

Namely, in the case that the storage capacity of the freezing chamber 11 should be increased, the first and second set of projections 31 and 32 can be fitted into the insert holes 52 and 57 which are formed at the lowest level of the insert holes, respectively.

The reason why the projections 31 and 32 can be inserted and removed into/from the insert holes 52 and 57, is because the inner wall 13 is so soft that when the intermediate partition wall 30 is inserted or removed, the inner wall 13 can be elastically pressed as much as the length of the extending projections 31 and 32.

On the other hand, in the case that the storage capacity of the cooling chamber 12 should be increased, the first and second set of projections 31 and 32 are fitted into the insert holes 51 and 56 which are formed at the middle level of the insert holes, respectively, or into the insert holes 50 and 55 which are formed at the highest level of the insert holes, respectively.

In order that the relative volume changes of the freezing and cooling chambers 11 and 12 can be carried out more extensively, other insert holes can be provided on the inner wall 13 to extend the shift range of the intermediate partition wall 30.

Figure 4:
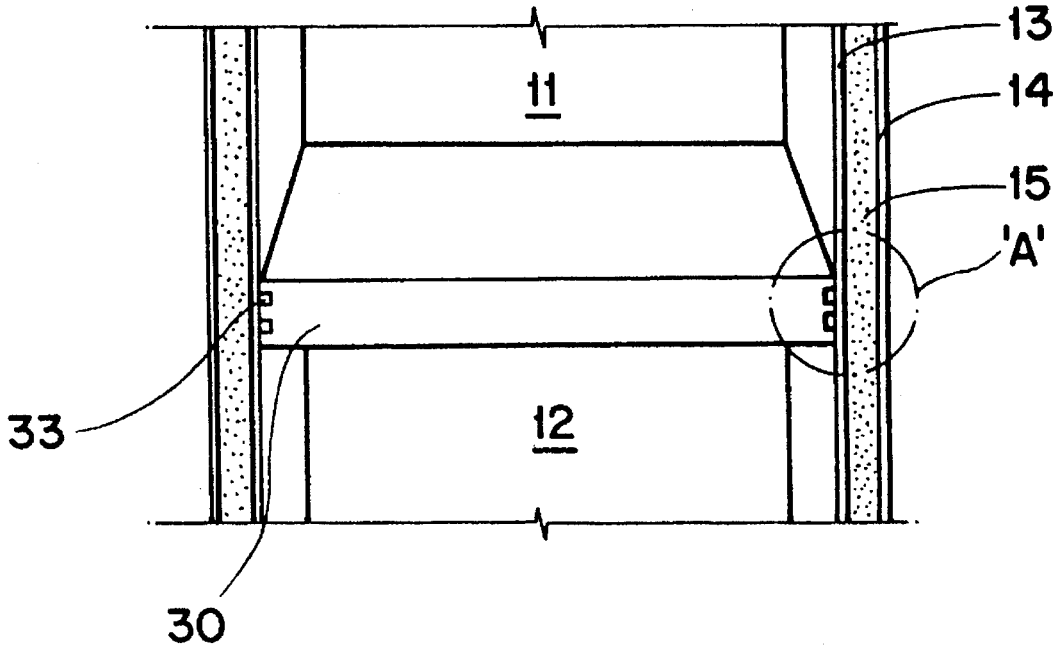
FIG. 4 is a cross sectional view taken along line 4—4 in FIG. 3.
Figure 5:
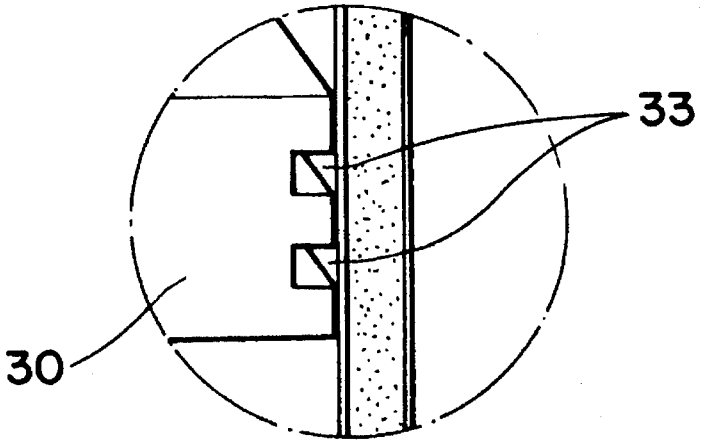
FIG. 5 is an enlarged view for a portion designated "A" in FIG. 4.
Figure 6:
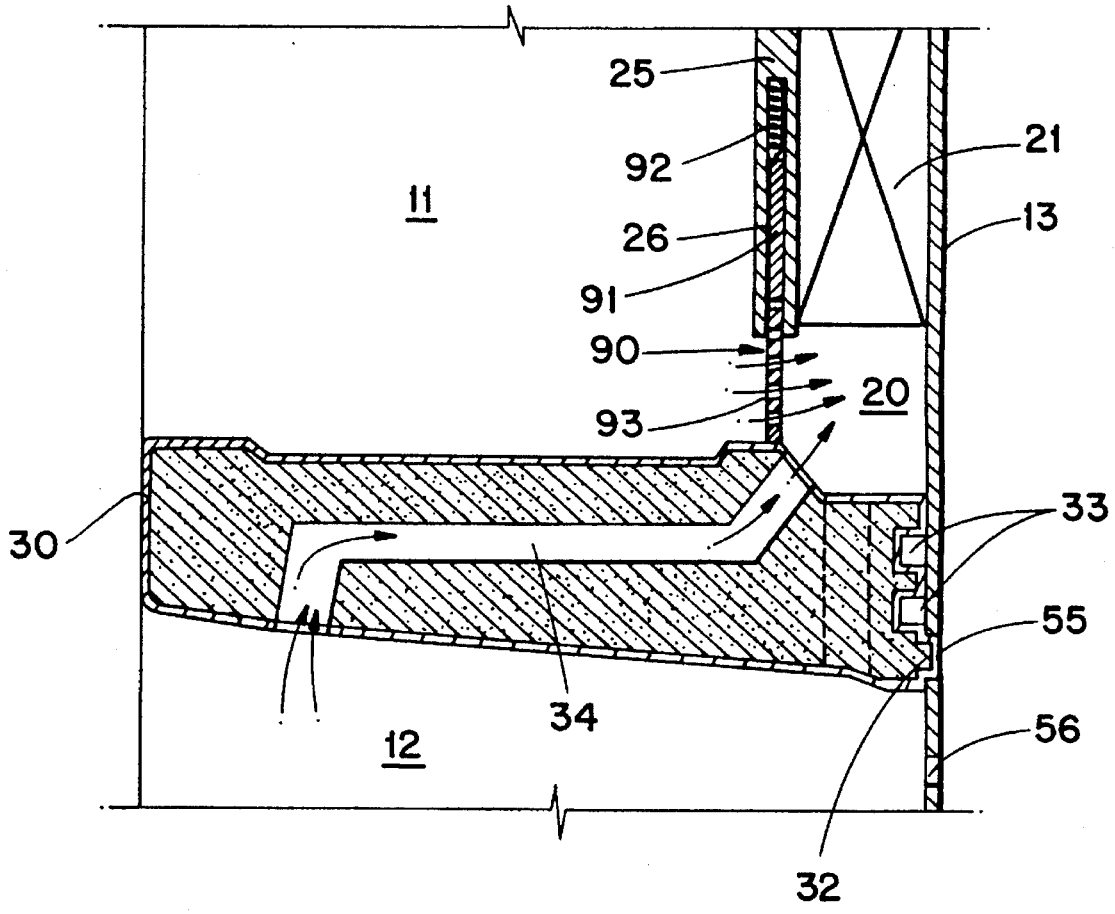
FIG. 6 is a partial vertical sectional view illustrating the one embodiment of the intermediate partition wall in accordance with this invention.

As shown in FIG. 4 to FIG. 6, a plurality of grooves 33 are formed lengthwise on the right and left side surfaces and rear surface of the intermediate partition wall 30. Thereby, in the condition that the intermediate partition wall 30 mounted in the inner wall 13, the right and left side surfaces **13*a* of the inner wall 13 contact airtightly against the right and left side surfaces of the intermediate partition wall 30, and the rear surface 13*b* of the inner wall 13 contacts airtightly the rear surface of the intermediate partition wall 30. Air spaces are formed between the intermediate partition wall 30 and inner wall 13 by the grooves 33, so that the freezing chamber 11 and the cooling chamber 12** are effectively thermally insulated from each other.

The shutting means 90 which is arranged under the isolating wall 25 is illustrated in detail in FIG. 6, and is required due to the position-shift of the intermediate partition wall 30.

As shown in FIG. 6, the freezing chamber 11 is isolated from the cooling apparatus compartment 20 by the isolating wall 25.

The bottom of the isolating wall 25 is spaced above the intermediate partition wall 30, and the space is increased or decreased due to the position-shift of the intermediate partition wall 30.

The shutting means 90 is comprised of a guide slot 26 which is formed in the lower end of the isolating wall 25 and extends about halfway up through the wall 25. A screen 91 is inserted into the guide slot 26, and a spring 92 is disposed between the top of the guide slot 26 and the screen 91.

The screen 91 is movable elastically in upward or downward directions by means of the spring 92 so that the variable space between the intermediate partition wall 30 and the isolating wall 25 is completely covered by the shutting means 90.

In order to circulate air from the freezing chamber 11 into the cooling apparatus compartment 20, the screen 91 has many through holes 93 formed at a regular interval.

Figure 7:
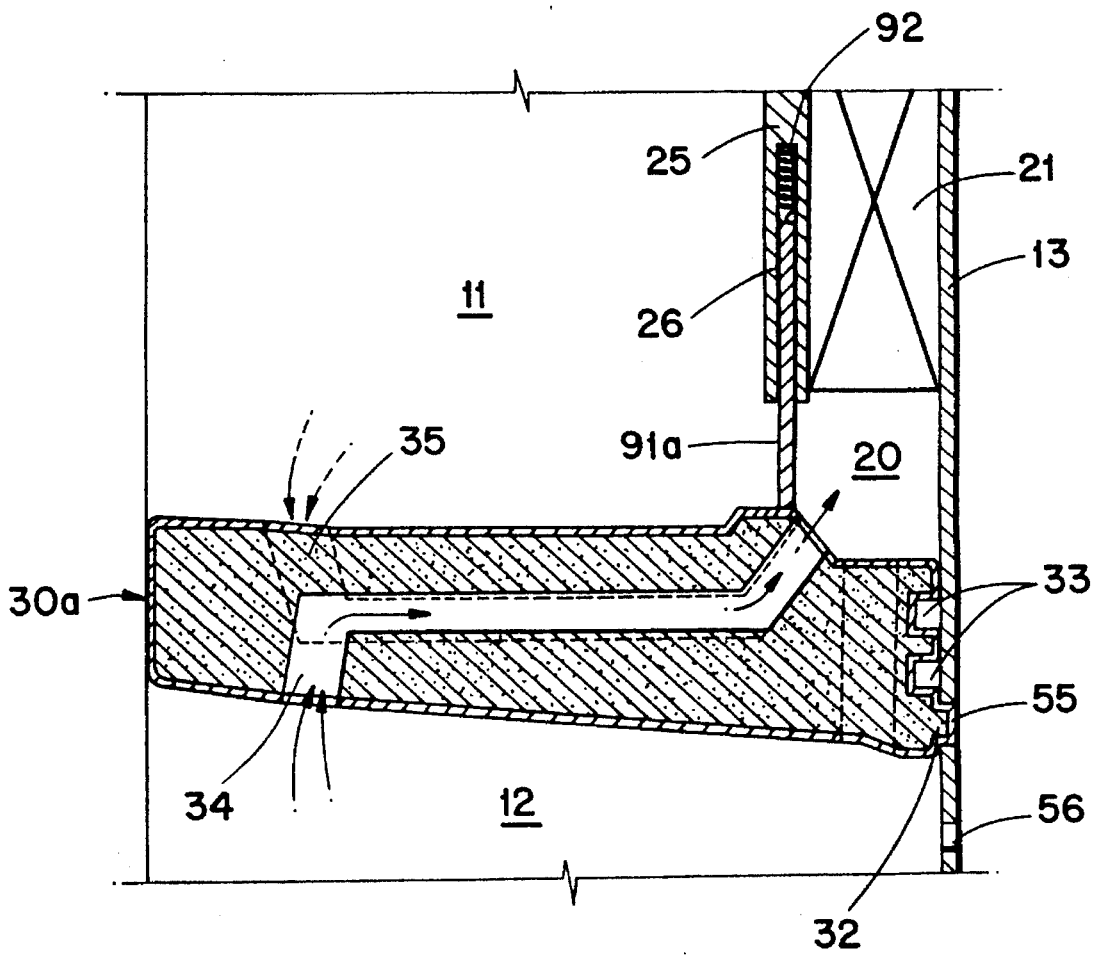
FIG. 7 is a view similar to FIG. 6 depicting another embodiment of the partition wall.

FIG. 7 illustrates another embodiment for directing the air from the freezing chamber 11 into the cooling apparatus compartment 20.

In the second embodiment, while the screen **91*a* does not have any through holes 93 for air circulation, the intermediate partition wall 30*a* has an air passage 35 and an air passage 34 for circulating the air from the freezing chamber 11 and cooling chamber 12 respectively into the cooling apparatus compartment 20**.

Further description of the second embodiment will be omitted because the second embodiment has the same structure as the first embodiment (as shown in FIG. 6), except for the cool air circulation structure.

Figure 8:
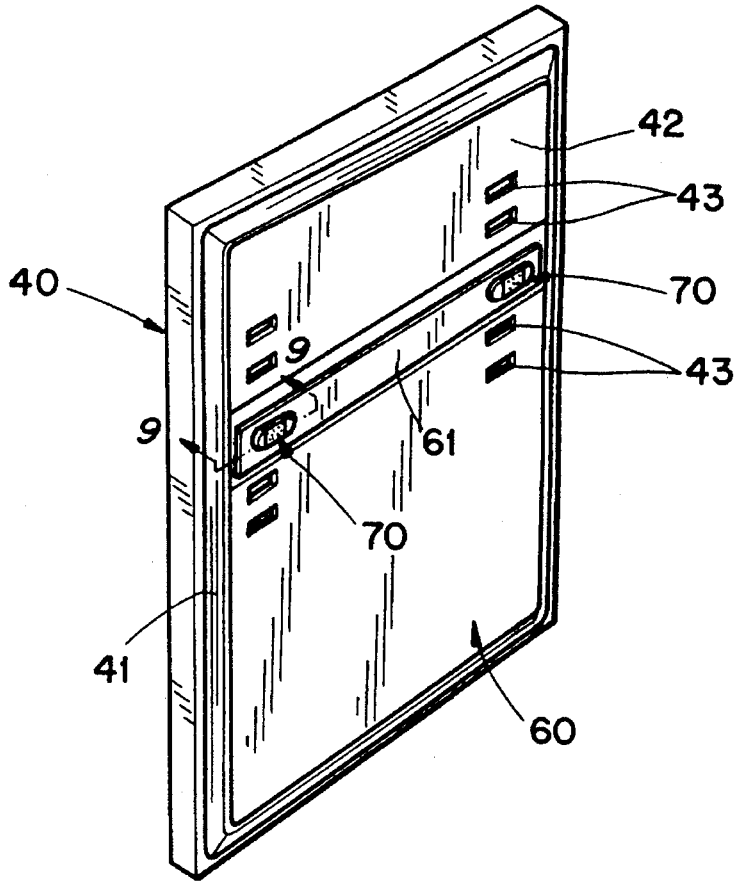
FIG. 8 is a perspective view illustrating the inner surface of a refrigerator door in accordance with this invention.
Figure 9:
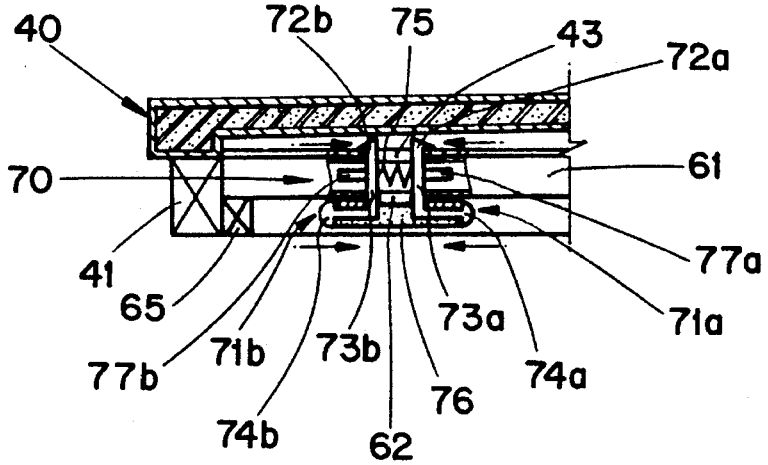
FIG. 9 is a cross sectional view taken along line 9—9 in FIG. 8.

FIG. 8 and 9 illustrate the sealing means 60 for sealing in an airtight manner the clearance between the front surface of the intermediate partition wall 30 and the refrigerator door 40. Gaskets 41 are attached to the periphery of the inner surface of the door 40, which are kept in a tight state with the front of the cabinet 10 when the door 40 is closed.

The sealing means 60 which is mounted on the inner surface of the door 40 is comprised of a door panel 42, a sealing member 61 which is mounted on the door panel 42 to contact the front surface of the intermediate partition wall 30 when door 40 is closed a pair of engaging members 70 for demountably engaging the sealing member 61 with the door panel 42, and gaskets 65 attached to the edge of the sealing member 61.

On the right and left sides of the door panel 42 several pairs of holes 43 are formed and on the right and left sides of the sealing member 61 a pair of openings 62 are formed. Each engaging member 70 is fitted in a respectively opening 62 of the sealing member 61 and in one row of the holes 43 of the door panel 42, so that the sealing member 61 is fixed to the door panel 42.

The structure of the engaging member 70 is well shown in FIG. 9 that is a cross sectional view taken along line II—II in FIG. 8.

The engaging member 70 for demountably engaging the sealing member 61 with the door panel 42 is comprised of first and second elements 71*a* and 71*b* each of which is formed in an L-shape, and a spring 75 and a rubber element 76" for elastically connecting the first and second elements 71*a* and 71*b* with each other.

The first element 71*a* is comprised of a hooked portion 72*a* which hangs on the insert hole 43 of the door panel 42, a connecting portion 73*a* extending inward from the hooked portion 72*a*, and an operating portion 74*a* which is bent at a right angle to the end of the connecting portion 73*a* so as to hang on the opening 62 of the sealing member 61.

The second element 71*b*, being the same as the first element 71*a*, is comprised of a hooked portion 72*b*, a connecting portion 73*b*, an operating portion 74*b*, and is arranged symmetrically with the first element 71*a*. Namely, the connecting portions 73*a* and 73*b* are placed parallel with each other, the hooked portions 72*a* and 72*b* are placed in opposite directions to each other, and the operating portions 74*a* and 74*b* are also placed in opposite directions to each other.

The spring 75 is disposed between the connecting portions 73*a* and 73*b*. The rubber element 76 is disposed between the operating portions 74*a* and 74*b*, so that the first and the second elements 71*a* and 71*b* are connected to each other by means of the element 76.

Further, in order to prevent the engaging member 70 from falling out of the opening 62 of the sealing member 61, stoppers 77*a* and 77*b* extend vertically from the outer surface of respective connecting portions 73*a* and 73*b* as shown in FIG. 9.

The method of changing the volumes of the freezing chamber 11 and the cooling chamber 12 in a variable volume type refrigerator in accordance with this invention will be now described in detail.

In order to increase the volume of the freezing chamber 11: first the intermediate partition wall 30 which is inserted into the highest insert holes 50 and 55 (as shown in FIG. 6), should be removed. In so doing, the first projections 31, which are formed on opposite side surfaces of the intermediate partition wall 30, should be taken out of the insert holes 50 on the right and left sides 13*a* of the inner wall 13. As described already, the inner wall 13 is made of a flexible material, so if the user widens the space between the right and left sides 13*a* of the inner wall 13 with his hands, then the first projections 31 are easily taken out of the insert holes 50 so that the intermediate partition wall 30 can be removed from the inner wall 13.

In order for the separated intermediate partition wall 30 to be inserted into the insert holes 51 and 56 in another row positioned under the insert holes 50 and 55, it is necessary to widen somewhat the space between the right and left sides 13*a* by hand. Then, the intermediate partition wall 30 is pushed into the inner wall 13 until the first projections 31 of the intermediate partition wall 30 enter the inserts 51, and the second projections 32 enter the insert holes 56. At this time, the screen 91 which is arranged under the isolating wall 25 is pushed downward by the spring 92 to cover the space between the intermediate partition wall 30 and the isolating wall 25.

With the above described downward shift of the intermediate partition wall 30, the sealing member 61 for sealing the clearance between the front of the intermediate partition wall 30 and the door 40 should be adjusted.

Firstly, in order to disengage the engaging member 60, which is used for fixing the sealing member 61 to a hole 43 in the door panel 42, from the door panel 42, if the operating portions 74*a* and 74*b* of the first and second elements 71*a* and 71*b* are pressed toward one another as shown by arrows in FIG. 9, with the spring 75 and the rubber element 76 being compressed, the hooked portions 72*a* and 72*b* are released from the hole 43 of the door panel 42, so that the sealing member 61 is separated from the door panel 42. At this time, the engaging member 70 retained in the opening 62 of the sealing member 61 by the stoppers 77*a* and 77*b*, as described already.

The disengaged sealing member 61 is inserted into other ones of the holes 43 which lie on the same level as the insert holes 51 and 56 of the inner wall 13, in which the intermediate partition wall 30 is placed.

Namely, if the user takes his hand off the operating portions 74*a* and 74*b* of the first and second elements 71*a* and 71*b* after inserting the sealing member 61 into the other holes 43 of the door panel 42, the spring 75 and the rubber 76 will return to a normal state so that the hooked portions 72*a* and 72*b* are hung on the other holes 43 of the door panel 42.

When the door 40 is closed in this condition, the front of the intermediate partition wall 30 and the sealing member 61 contact each other in an airtight manner through the use of the gaskets 65 attached to the edge of the sealing member 61. Consequently, the freezing chamber 11 and the cooling chamber 12 are completely isolated from each other.

As you can understand from the above description, this invention has an advantage in that the utility efficiency of the foodstuff's storage space in a refrigerator is enhanced. It is because the intermediate partition wall, which causes the freezing chamber and the cooling chamber to be isolated from each other, is easily demountably fitted in the inner wall of the cabinet and the installation position of the intermediate partition wall can be moved in upward or downward direction, and therefore the storage capacity of the freezing chamber and the cooling chamber can be varied as needed.

What is claimed is:

1. A refrigerator, comprising:

a cabinet forming a food storage space;

a door for opening and closing said space;

a horizontal intermediate partition wall for dividing said storage space into separate freezing and cooling compartments, said partition wall being vertically adjustable for increasing a volume of one of said compartments while reducing a volume of the other of said compartments;

an evaporator mounted in one of said freezing and cooling compartments; and a vertical isolating wall in said one compartment for isolating said evaporator from a remainder of said one compartment, at least a portion of said isolating wall being vertically adjustable for making contact with said partition wall in various positions of adjustment of said partition wall.

2. The refrigerator according to claim 1, wherein said freezing compartment is situated above said cooling compartment.

3. The refrigerator according to claim 1, wherein said partition wall separates said freezing and cooling compartments in an airtight manner.

4. The refrigerator according to claim 1, further including sealing means mountable on said door for engaging a front surface of said partition wall, said sealing means being vertically adjustable relative to said door to be positioned for engagement with said front surface in various positions of vertical adjustment of said partition wall.

5. The refrigerator according to claim 1, including a spring for biasing said portion of said isolating wall toward and against said partition wall.

6. The refrigerator according to claim 1, wherein said portion of said isolating wall includes apertures for communicating said evaporator with said one compartment.

7. The refrigerator according to claim 1, wherein said partition wall has formed therein first and second passages for communicating said freezing and cooling compartments, respectively, with said evaporator.

8. The refrigerator according to claim 1, wherein said evaporator and said isolating wall are in said freezing compartment.

9. The refrigerator according to claim 1, wherein said space includes an inner wall formed of resiliently flexible material, said inner wall having vertically spaced rows of openings for receiving projections of said partition wall for enabling said partition wall to be vertically adjusted.

10. The apparatus according to claim 9, wherein said inner wall includes vertical sides and a vertical back, each of said sides including an opening of each row, and said back including at least one opening of each row, said partition wall including lateral projections receivable in respective openings of said side, and at least one projection receivable in said at least one opening of said back.

11. A refrigerator, comprising:

a cabinet forming a food storage space;

a door for opening and closing said space; and a horizontal intermediate partition wall for dividing, in an airtight manner, said storage space into separate upper and lower food storage compartments maintained at different temperatures, said partition wall being vertically adjustable for increasing a volume of one of said compartments while reducing a volume of the other of said compartments;

said door including a vertically adjustable sealing member for sealing against a front surface of said partition wall.

12. A refrigerator, comprising:

a cabinet forming a food storage space;

a door for opening and closing said storage space; and a horizontal intermediate wall for dividing said storage space into a freezing compartment and a cooling compartment, said partition wall being vertically adjustable for increasing a volume of one of said compartments while simultaneously reducing a volume of the other of said compartments;

said door including a horizontally extending sealing device engageable with a front surface of said partition wall for creating a seal therewith, said sealing means being vertically adjustable to conform with various positions of adjustment of said partition wall.

13. The refrigerator according to claim 12, wherein said door includes an inner wall having a plurality of vertically spaced holes, said sealing device extending horizontally across said door and carrying engaging members selectively engageable in said vertically spaced holes for varying a vertical position of said sealing device.

14. The refrigerator according to claim 13, wherein each engaging member includes a pair of elements having hooks for removably engaging respective ones of said holes, and an elastic member for biasing said elements of each pair away from one another to a position securing said partition wall in place.

15. The refrigerator according to claim 12, wherein a gasket extends around an outer edge of said sealing member for engaging said front surface.

16. A refrigerator, comprising:

a cabinet forming a food storage space;

a door for opening and closing said space;

a horizontal intermediate partition wall for dividing said storage space into separate freezing and cooling compartments, said partition wall being vertically adjustable for increasing a volume of one of said compartments while reducing a volume of the other of said compartments; and a sealing structure mountable on said door for engaging a from surface of said partition wall, said sealing structure being vertically adjustable relative to said door to be positioned for engagement with said front surface in various positions of vertical adjustment of said partition wall.

* * * * *